US005756951A

United States Patent [19]

Manthe et al.

[11] Patent Number: 5,756,951

[45] Date of Patent: May 26, 1998

[54] ARC CHUTE HAVING THREE BARRIERS FOR THE PASSAGE OF ARC GASSES

[75] Inventors: Karl-Heinz Manthe; Martin Böttcher; Günter Seidler-Stahl, all of Berlin, Germany

[73] Assignee: Siemens Aktiengesellschaft, München, Germany

[21] Appl. No.: 714,158

[22] PCT Filed: Mar. 10, 1995

[86] PCT No.: PCT/DE95/00347

§ 371 Date: Sep. 23, 1996

§ 102(e) Date: Sep. 23, 1996

[87] PCT Pub. No.: WO95/26033

PCT Pub. Date: Sep. 28, 1995

[30] Foreign Application Priority Data

Mar. 21, 1994 [DE] Germany ..... 44 10 108.2

[51] Int. Cl.[6] ..... H01H 33/18; H01H 33/08

[52] U.S. Cl. ..... 218/35; 200/144 R; 200/144 C; 200/144

[58] Field of Search ..... 218/35; 335/174, 335/173, 35; 200/148 G, 144 R, 144, 147 R, 147 C

[56] References Cited

U.S. PATENT DOCUMENTS

| | | | |
|---|---|---|---|
| 2,310,728 | 2/1943 | Bartlett | 200/147 |
| 2,445,190 | 7/1948 | Spiro et al. | 200/144 |
| 3,005,892 | 10/1961 | Yarrick | 200/144 |
| 3,440,378 | 4/1969 | Baird | 200/144 |
| 3,621,169 | 11/1971 | Heft | 200/144 R |
| 4,388,506 | 6/1983 | Murai | 200/144 R |
| 4,511,773 | 4/1985 | Heft et al. | 200/144 C |
| 4,609,797 | 9/1986 | Morton et al. | 200/144 R |

FOREIGN PATENT DOCUMENTS

| | | |
|---|---|---|
| 360367 | 3/1990 | European Pat. Off. . |
| 1021054 | 12/1957 | Germany . |
| 1238538 | 4/1967 | Germany . |
| 2133926 | 1/1973 | Germany . |
| 2905854 | 3/1983 | Germany . |
| 3541514 | 5/1987 | Germany . |
| 9115905 | 6/1993 | Germany . |
| 851517 | 7/1981 | U.S.S.R. . |
| 1756962 | 8/1992 | U.S.S.R. . |
| 2152755 | 8/1985 | United Kingdom . |
| WO-93/13538 | 7/1993 | WIPO . |

*Primary Examiner*—Robert Nappi
*Assistant Examiner*—Rajnikant B. Patel
*Attorney, Agent, or Firm*—Kenyon & Kenyon

[57] ABSTRACT

An arc chute for a circuit-breaker has a chute member with arc splitters and an end member that seals off the chute member to the top. The end member has three barriers for arc gases, the first and the second barrier have webs with a more or less square cross-sectional shape which are arranged in double the pitch of the arc splitters. Situated above the second barrier is a cooling chamber, which is sealed off to the outside by the third barrier that is provided with outlet orifices.

14 Claims, 2 Drawing Sheets

ARC CHUTE HAVING THREE BARRIERS FOR THE PASSAGE OF ARC GASSES

BACKGROUND OF THE INVENTION

The invention relates to an arc chute for a circuit-breaker, comprising a chamber housing, arc runners arranged in the chamber housing, and comprising arc splitters supported with clearance between the arc splitters, as well as comprising a cooling arrangement for emergent arc gases, which is disposed above the arc splitters and includes three barriers, the first barrier being disposed directly above the arc splitters, and the second barrier being disposed with clearance from the first barrier, and the first and the second barriers having flow-through openings directed parallel to the end faces of the arc splitters, furthermore comprising a cooling chamber, which is adjacent to the second barrier and is sealed off to the outside by the third barrier that is provided with outlet orifices.

An arc chute of the afore-mentioned type is disclosed by U.S. Pat. No. 3,005,892. The barriers are formed by slitted or slotted plate-shaped insertion pieces in the chamber housing. During operation of the circuit-breaker, these component parts are subjected to very high loads. Therefore, in attempting to achieve a satisfactory lifetime of the component parts, one is only able to attain a limited cooling action. This has an effect on the safety distance to grounded components, which has to be observed when installing the circuit-breaker in a switchgear assembly in order to avoid an electric sparkover caused by the emergence of hot ionized gases out of the arc chute.

SUMMARY OF THE INVENTION

The object of the invention is to so improve the cooling effect of the barrier arrangement that, given the smallest possible dimensions and a long lifetime, only a minimal safety distance to the grounded components will be needed on the outlet side of the arc chute.

The means for attaining the object of the invention are embodied by the following features:

- the first barrier is formed by webs of the chamber housing, which are arranged in double the pitch of the arc splitters and each web of the first barrier serves as a support for one arc splitter;
- the second barrier is likewise formed by webs of the chamber housing, which are disposed opposite the webs of the first barrier, staggered from the webs of the first barrier by the pitch of the arc splitters; and
- the width and the height of the webs correspond more or less to the pitch of the arc splitters.

It turns out that a substantially stronger arrangement is able to be realized with the web configuration than with slitted or slotted plate-shaped components, so that the entire arc chute can be designed for a higher arc gas pressure. Therefore, the invention is especially suited for fabricating compact circuit-breakers having a high switching capacity.

Arranging webs above the arc splitters of an arc chute so that every second arc splitter rests against a web is known, per se, from the German Published Unexamined Application 35 41 514. At the same time, that reference discloses that the webs form an outlet grid for arc gases. Should the arc gases need to be cooled to a greater extent on account of there existing only a very small or insignificant distance to the grounded components, then the normal arc chute is provided with an attachable piece, whose inlet side is situated above the web configuration. In contrast, an arc chute is devised by the invention which does not require any additional attachable piece and, in spite of small dimensions, only requires a minimal distance to the grounded components.

In the arc chute disclosed by U.S. Pat. No. 3,005,892 mentioned at the outset, the cooling chamber situated between the second and the third barrier is designed as a mixing chamber, into which the arc gases can enter directly, not only right through the first and the second barrier, but also passing to the side of said barriers. In contrast, according to another embodiment of the present invention, an arc runner and the adjacent arc splitter are covered in each case by an end web so as to allow the arc gases to enter into the cooling chamber situated between the second and the third barrier only along the webs of the second barrier.

Besides having a greater mechanical strength than the slitted, plate-shaped parts, the webs, which have the dimensions indicated at the outset, exert a stronger directional effect on the arc gases than the slitted plates are capable of. This property can be enhanced further by giving the webs of the first and the second barrier a more or less square cross-sectional shape and by having the spacing between the barriers amount to 0.1 to 0.5 times the height of the webs. This configuration forces the arc gases, when flowing through the first and the second barriers, to change directions by 90° two times, partial gas flows being deflected toward one another above the webs of the first barrier and, by this means, being retarded. The gases then enter into the cooling chamber, having undergone an intensive turbulence and expansion, and thereby lose most of their ionization. Therefore, the temperature and the degree of ionization of the gases is so greatly lowered that only a small safety distance to the grounded parts needs to still be observed.

By subdividing the chamber housing into a chute member that accommodates the arc splitters and an end member that seals off the chute member to the top, as known, per se, for example from the German Patent 29 05 854, the first, the second, and the third barriers can be formed as components of the end member. This design proves to be favorable for manufacturing the web arrangement, while giving it considerable strength. As already mentioned, every second arc splitter rests against a web of the first barrier. This makes it superfluous to have a separate attachment device for the arc splitters situated in-between, because the webs of the first barrier are joined, at the rim, by a crosspiece, which forms a support for each second arc splitter that does not rest against one of the webs of the first barrier. Thus, by placing the end member on the chute member, all arc splitters are gripped and secured against shifting.

The outlet orifices of the third barrier can have a slit-type design and can be disposed parallel to the webs of the first and the second barrier, however staggered in relation to said webs, in an end wall of the end member. The amount of time the arc gases stay in the cooling chamber and their flow velocity can be influenced by the number and arrangement of these outlet orifices. This can be achieved, in particular, by arranging the outlet orifices in a pitch that deviates from the webs of the first and the second barrier. The end member can be manufactured as a uniform hollow body out of a thermosetting plastic.

In contrast to the common blow-out dampers on arc chutes under known methods heretofore, other than the arc splitters, the arc chute according to the invention does not have any supplementary metal parts that have to be manufactured and mounted separately.

DETAILED DESCRIPTION

Figure 1:
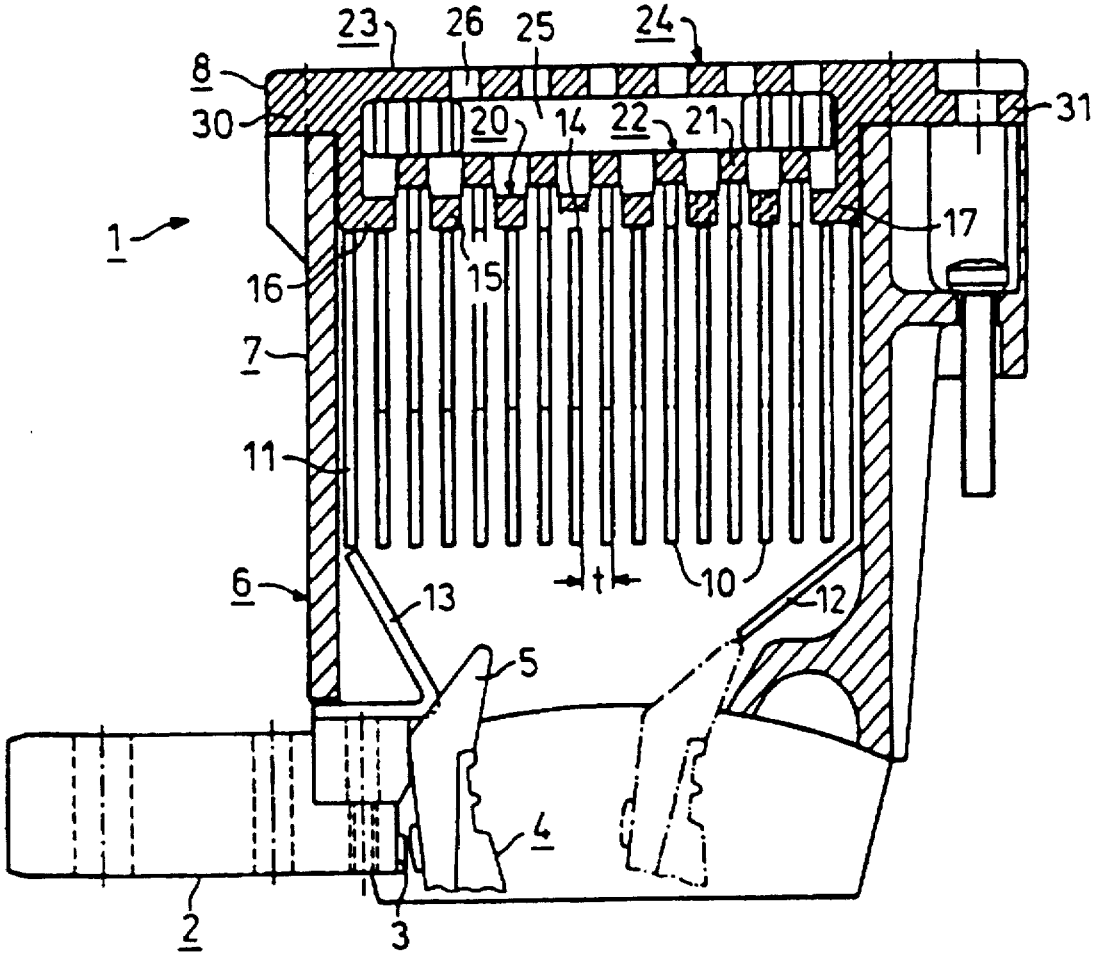
FIG. 1 depicts an arc chute of a low-voltage circuit-breaker having a movable switching contact.

The arc chute 1 according to FIG. 1 is a component of a low-voltage circuit-breaker for applications up to 1000 V and having a switching capacity of up to about 100,000 A. Since the design of the circuit-breaker is not central to the invention, only an upper connecting bar 2 with a stationary contact member 3 and a corresponding, movable contact lever 4 comprising an arcing horn 5 are shown. The closed position is drawn with a solid line; the open position of the contact lever 4 is indicated by a dot-dash line.

The arc chute 1 has a two-part chamber housing 6 with a lower chute member 7 and an end member 8 sealing off said chute member at the top. Arc splitters 10 are arranged with clearance between them in the chute member 7. This arc splitter arrangement is bounded on each side by one arc runner 11 or 12, the left arc runner 11 facing opposite a stationary arcing horn 13 with minimal clearance, and the right arc runner 12 being so angled at the lower end, that the movable contact lever, with its arcing horn 5, rests against the end of the angled section when it is in the open position.

The arc splitters 10 terminate in one plane near the upper end of the chute member 7 and are secured against shifting in the longitudinal direction by the end member 8. For this purpose, the end member 8 has a plurality of webs 15 such that a web 15 faces opposite an end face 14 of every second arc splitter 10. A left end web 16 and a right end web 17 are designed to be wider than the webs 15 so as to allow the last arc splitter 10 and the adjacent arc runner 11 or 12 to rest against the end web 16 and 17, respectively. The webs 15, in connection with the end webs 16 and 17, form a first barrier 20 for arc gases which form during switching and which must be cooled and deionized before being discharged into the open air.

Situated above the first barrier 20 is a second barrier 22 formed by webs 21. The webs 21 are staggered from the webs 15 by one pitch of the arc splitters 10, so that facing opposite every second arc splitter with clearance is a web 21.

Figure 2:
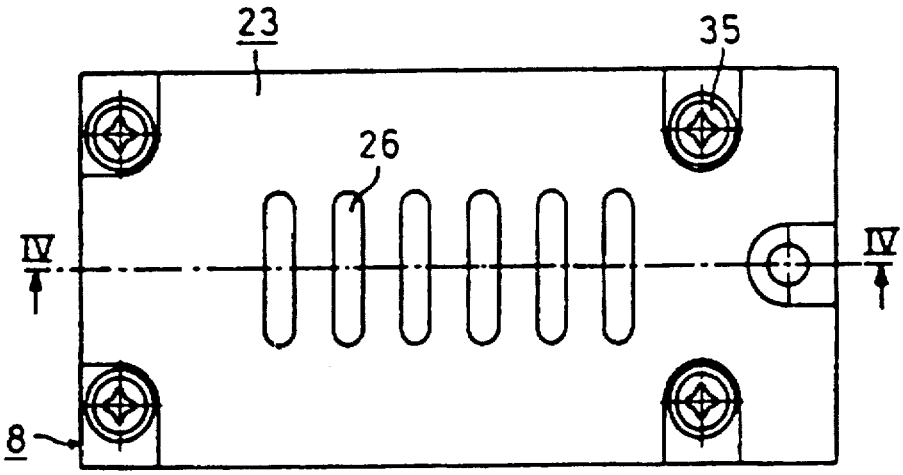
FIG. 2 illustrates a plan view of the arc chute in accordance with FIG. 1.
Figure 4:
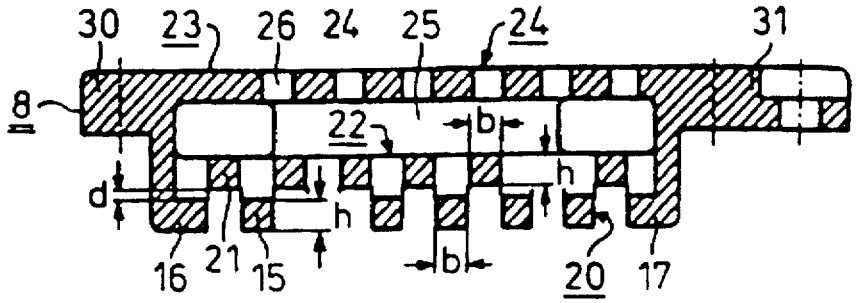
FIGS. 4 and 5 illustrate the sections IV—IV and V—V, respectively, of FIG. 3.

In accordance with FIGS. 1 and 4, the cross-sectional shape of the webs 15 and 21 is the same and nearly square. The width b and the height h of the webs 15 and 21 conform more or less to the pitch t of the arc splitters 10. A third barrier 24 is formed by an end wall 23 of the end member 8. The end wall 23 contains the outlet orifices 26 (FIG. 2), through which the cooled and deionized arc gases leave the arc chute 1. While the first and the second barriers 20 and 22 have only a small clearance d between them (FIG. 4), which amounts more or less to one fourth of the width b or the height h of the webs 15 or 21, a larger distance is provided between the second and the third barriers 22 and 24, by means of which a cooling chamber 25 is formed. The outlet orifices 26 of the third barrier 24 have an elongated shape and are arranged parallel to the webs 15 and 21 of the first and the second barriers 20 and 22.

Figure 3:
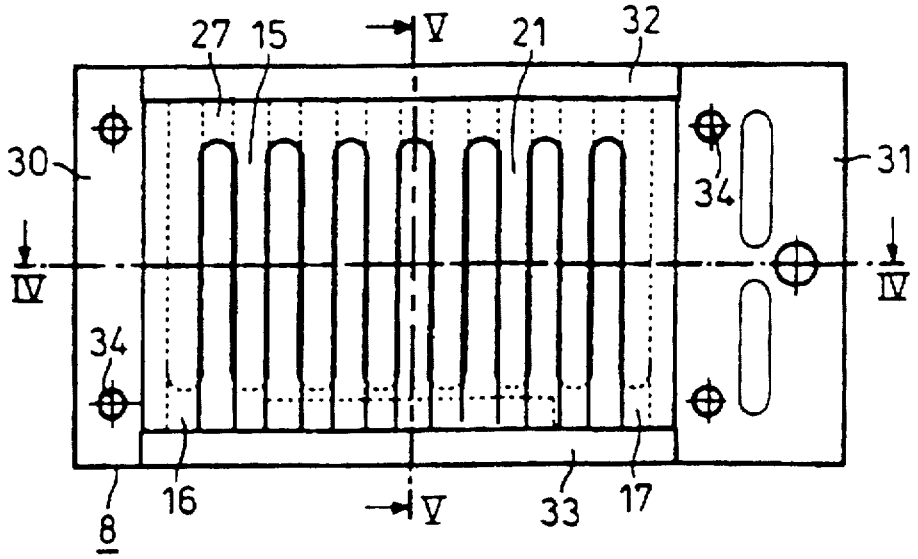
FIG. 3 shows an end piece of the arc chute in accordance with FIGS. 1 and 2, looking at the bottom side facing the interior space.

As FIG. 3 elucidates further, the webs 15 of the first barrier 20 are interconnected at the rim side by a crosspiece 27. By this means, a contact surface is also formed for those arc splitters 10 which do not rest against the webs 15 of the first barrier 20. Furthermore, as revealed by a comparison of FIGS. 2 and 3, the outlet orifices 26 are shorter than the openings formed by the webs 15 and 21. Also, the pitch of the outlet orifices 26 is selected to deviate from the pitch (FIG. 1) of the webs 15 and 21. It is thus avoided that an outlet orifice 26 stands exactly opposite a clearance space between the webs 21.

Figure 5:
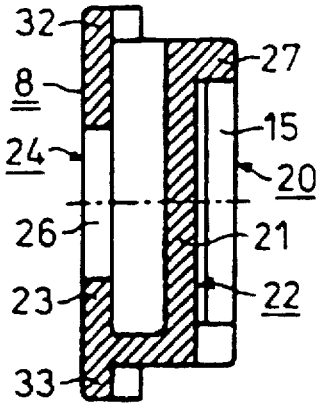

As shown in FIGS. 4 and 5, the end member 8 has edge pieces 30, 31, as well as 32 and 33 that project out on all sides for engaging on the front-side end of the chute member 7. Through-holes 34 in the corners of the edge pieces are provided for connecting the end member 8 and the chute member 7 by means of screws 35.

To break an electric circuit, the contact lever 4 is moved out of the position shown with a solid line into the position indicated by a dot-dash line. In a generally known manner, the developing arc is drawn from the stationary contact member 3 and the arcing horn 5 of the contact lever 4 to the arc runners 11 and 12. The magnetic and thermal lifting forces then pull the arc into the arc splitter arrangement (arc splitters 10, FIG. 1) and split it there into a number of partial arcs corresponding to the number of arc splitters 10. The arc gases produced until the arc is extinguished escape through the arrangement of barriers 20, 22 and 24 to the outside. Because of their relatively large height and their parallel edges, the webs 15 of the first barrier 20 thereby exert a directional effect on the gas stream. The partial gas streams then meet with the bottom surfaces of the webs 21 of the barrier 22 and, because of the small distance d between the webs 15 and 21, are diverted by about 90°. In the space between two adjacent webs 21 of the second barrier 22, two diverted partial streams of the arc gases flow against one another and are only able to leave the space between the webs 21 after being diverted again by 90° in the direction of the cooling chamber 25. This takes place under vigorous turbulence and expansion. Associated with this are an intensive cooling and a recombination of charge-carriers.

The amount of time the arc gases stay in the cooling chamber 25 is influenced by dimensioning the outlet orifices 26. Even though the described arrangement of barriers 20, 22, and 24 is very effective, it only uses up a relatively small part of the total height of the arc chute 1. In addition, no conductive parts, such as wire fabric, grids of expanded metal or similar elements are needed to effect the desired cooling and deionization of the arc gases. Therefore, the described arc chute 1 also has the distinguishing feature of providing substantial protection from electrical sparkovers at the outlet side of the arc splitters 10. The safety distance to grounded components is diminished to a small size of about 20–60 mm.

What is claimed is:

1. An arc chute for a circuit-breaker, comprising:

a chamber housing, arc runners arranged in the chamber housing, arc splitters supported in the chamber housing, with clearance between adjacent arc splitters, a cooling arrangement for emergent arc gases which is disposed above the arc splitters and which includes three barriers, the first barrier being disposed directly above the arc splitters and the second barrier being disposed with clearance from the first barrier, the first and the second barriers each having flow-through openings directed parallel to end faces of the arc splitters, and further comprising a cooling chamber adjacent to the second barrier and sealed off from the outside by the third barrier that is provided with outlet orifices, wherein the first barrier is formed by webs of the chamber housing which are arranged having a pitch double a pitch of the arc splitters wherein each of the webs of the first barrier serves as a support for one arc splitter;

wherein the second barrier is likewise formed by webs of the chamber housing which are disposed opposite the webs of the first barrier, staggered by the pitch of the arc splitters; and wherein the width and the height of the webs of the first barrier and the webs of the second barrier substantially correspond to the pitch of the arc splitters.

2. An arc chute as defined by claim 1, wherein an arc runner and the adjacent arc splitter are covered in each case by an end web so as to allow the arc gases to enter into the cooling chamber situated between the second and the third barrier only between the webs of the second barrier.

3. An arc chute as defined by claim 1, wherein the webs of the first barrier and the webs of the second barrier have a substantially square cross-sectional shape and wherein the spacing between the first and second barriers amounts to 0.1 to 0.5 times the height of the webs.

4. An arc chute as defined by claim 1, wherein the chamber housing comprises a chute member that accommodates the arc splitters and an end member that seals off the chute member to the top, wherein the first, the second, and the third barriers are components of the end member.

5. An arc chute as defined by claim 4, wherein the webs of the first barrier are joined by a crosspiece which forms a support for each second arc splitter that does not rest against one of the webs of the first barrier.

6. An arc chute as defined by claim 4, wherein the outlet of orifices of the third barrier have a slit-type design and are disposed parallel to the webs of the first and the second barrier, staggered in relation to said webs, in an end wall of the end member.

7. An arc chute as defined by claim 6, wherein the outlet orifices are arranged in a pitch that differs from the pitch of the webs of the first and the second barrier.

8. An arc chute as defined by claim 4, wherein the end member is manufactured as a uniform hollow body out of a thermosetting plastic.

9. An arc chute as defined by claim 2, wherein the webs of the first barrier and the webs of the second barrier have a substantially square cross-sectional shape and wherein the spacing between the first and second barriers amounts to 0.1 to 0.5 times the height of the webs.

10. An arc chute as defined by claim 2, wherein the chamber housing comprises a chute member that accommodates the arc splitters and an end member that seals off the chute member to the top, wherein the first, the second, and the third barriers are components of the end member.

11. An arc chute as defined by claim 10, wherein the webs of the first barrier are joined by a crosspiece which forms a support for each second arc splitter that does not rest against one of the webs of the first barrier.

12. An arc chute as defined by claim 10, wherein the outlet orifices of the third barrier have a slit-type design and are disposed parallel to the webs of the first and the second barrier, staggered in relation to said webs, in an end wall of the end member.

13. An arc chute as defined by claim 12, wherein the outlet orifices are arranged in a pitch that differs from the pitch of the webs of the first and the second barrier.

14. An arc chute as defined by claim 10, wherein the end member is manufactured as a uniform hollow body out of a thermosetting plastic.

* * * * *